United States Patent [19]

Lipman

[11] 4,342,349

[45] Aug. 3, 1982

[54] APPARATUS AND METHOD FOR GROOVING A BOARD-LIKE MATERIAL, A GROOVING TOOL THEREFOR AND A STRUCTURE MADE BY THE METHOD

[76] Inventor: Daniel Lipman, 741 Leslie La., East Meadow, N.Y. 11554

[21] Appl. No.: 121,649

[22] Filed: Feb. 15, 1980

[51] Int. Cl.[3] ..... B27C 5/00

[52] U.S. Cl. ..... 144/371; 83/875; 144/136 R

[58] Field of Search ..... 83/875; 144/2 R, 3 R, 144/136 R, 136 D, 136 E, 323, 326 R

[56] References Cited

U.S. PATENT DOCUMENTS

| | | | |
|---|---|---|---|
| 1,623,020 | 3/1927 | Norris | 144/136 R |
| 3,605,534 | 9/1971 | Barr | 83/875 |
| 3,744,659 | 7/1973 | Koehler | 144/136 R |
| 3,752,021 | 8/1973 | Klien et al. | 83/875 |
| 3,875,835 | 4/1975 | Roberts | 83/875 |
| 3,995,516 | 12/1976 | Boily et al. | 83/875 |
| 4,054,165 | 10/1977 | Karakawa | 83/875 |

*Primary Examiner*—W. D. Bray

*Attorney, Agent, or Firm*—Curtis, Morris & Safford

[57] ABSTRACT

Apparatus and method for forming V-shaped grooves in a board material including a grooving tool having a V-shaped leading cutting edge with a preselected included angle for cutting a V-shaped groove to a preselected depth in the board material, means for producing relative movement of said grooving tool and said board material to cut the V-shaped groove in said board material, guide means for inhibiting nonlinear relative movement of said grooving tool and said board material to cause a straight groove to be cut in said board. The board material thus grooved may be folded to form structures for use as boxes and in certain furniture applications.

38 Claims, 7 Drawing Figures

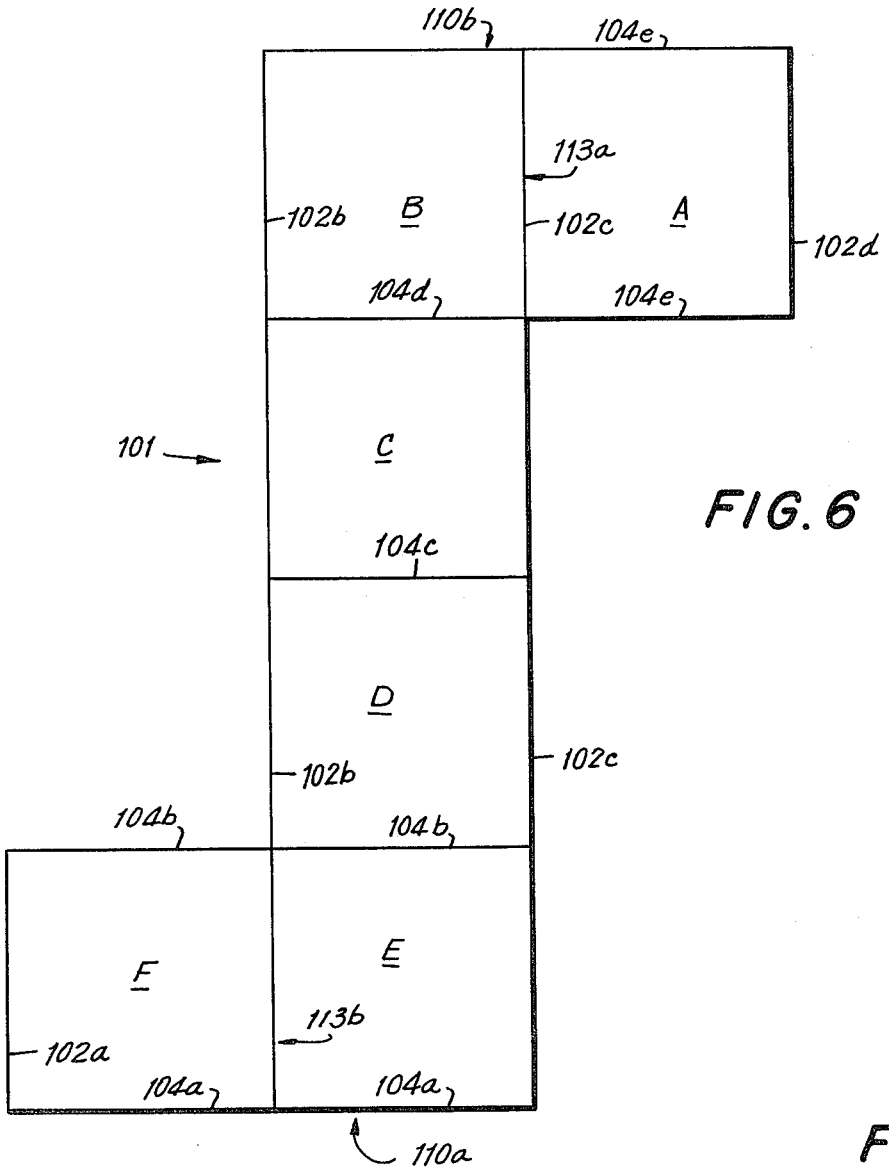
FIG. 6
FIG. 7
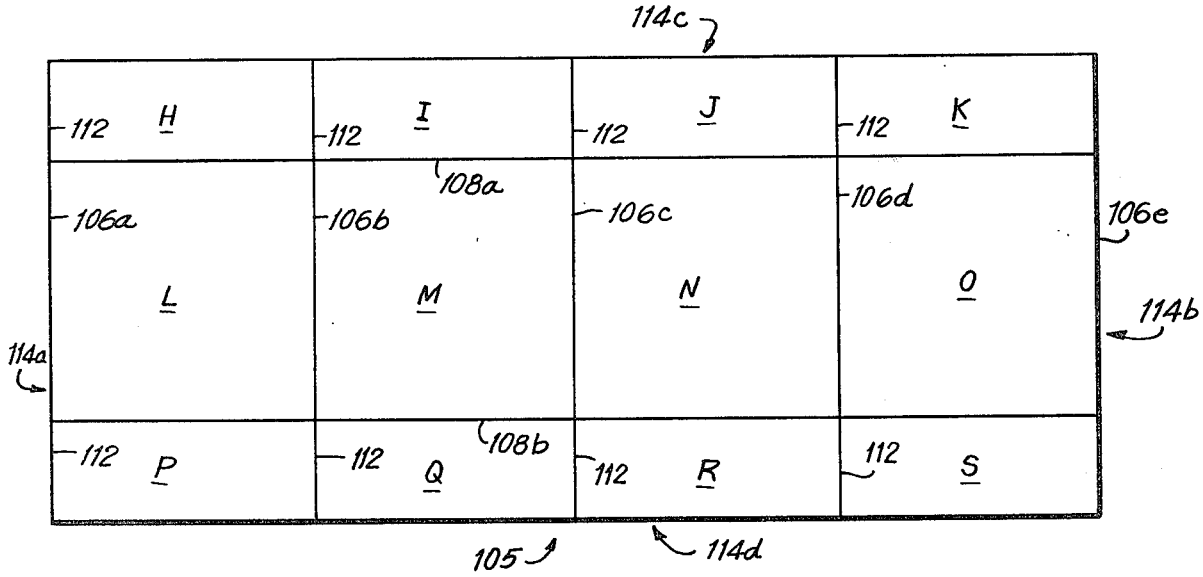

APPARATUS AND METHOD FOR GROOVING A BOARD-LIKE MATERIAL, A GROOVING TOOL THEREFOR AND A STRUCTURE MADE BY THE METHOD

BACKGROUND OF THE INVENTION

The invention relates to forming V-shaped grooves in board materials such as paperboard, chipboard and particle board and more particularly to a method and apparatus for groove folding such board materials to form structures, such as boxes.

In a desire to lower cost by using more plentiful materials, box makers and furniture makers are turning away from wood and the like in favor of composite board materials for forming both decorative and structural panels. It has been customary, in forming the four sides of a wooden box to join four panels together at their edges using a joint such as a butt joint or a dovetail joint. However, butt joints are relatively weak and dovetail joints involve manipulations which are detailed and therefore expensive. Dovetail joints require cutting or punching notches and projections in both ends of all boards, applying glue, fitting the interlocking notches and projections of the four panels together to form the sides of the box and blocking the four-sided structure in a rectangular shape until the glue sets. A further finishing operation to trim the projections may also be required. In addition to the cost of such an operation, the step of cutting or punching the notches and projections produces a large quantity of dust and small scrap material which must be collected and disposed of.

Boxes have also been made by routing grooves in flake board with a rotating routing tool. Flake board is a dense, hard material made of wood shavings and chips bonded into a board. Routing the flake board produces large quantities of dust which may present a health hazard to those working with this process.

Paper boxes or box-like structures of light weight paperboard or of corrugated paperboard may be fabricated by creasing a single piece of the board and folding the board along the crease lines which define the box corners. The fold or crease lines are produced by cutting partially through the material or by compressing grooves in the material. However, compression grooving is not effective to define corners on all thicknesses of solid paperboard or particle board. As board thickness increases, the stiffness of the board and its limited receptivity to creasing causes the board fibers at the outer radii of the corners to crack and break due to tension in the fibers. Even at lesser thicknesses, corners formed by compression grooving and folding are often unsatisfactory since they are rounded and not sharply defined.

In order to bend thicker paperboard to produce reasonably square corners, a process known as step grooving has been used. Step grooving consists of removing a first relatively wide and shallow rectangular strip of material and then removing a relatively narrow and deep rectangular strip of material from the center of the wide and shallow groove. The paperboard is then folded along the line thus defined.

However, step grooving has several disadvantages. Step grooving requires two grooves and produces a large amount of scrap. Also, the resulting grooves are generally ragged since shreds of paper fibers are attached to the walls of the grooves. In addition, the opposed edges of the step grooves abut in an irregular fashion when they are folded to form a corner. Furthermore, the outside edges of the corners so formed are not sharply defined.

SUMMARY OF THE INVENTION

The present invention overcomes the disadvantages of the prior art by providing a device which slides a V-shaped groove in thick board material. The V-shaped groove is cut at a predetermined included angle and is cut so that the sides of the V-shaped groove are smooth. Thus, the opposing sides of the V-shaped groove form a strong close fitting corner when folded together. By controlling the depth of the V-shaped groove in the board, the corner may be sharply defined to avoid the rounded corners obtained with many prior art methods.

The present invention also reduces the health hazards associated with the dust formed during prior art processes, since each V-shaped groove of the present invention is formed by removing a single V-shaped fillet of board material which is easily disposed of. Furthermore, the present invention is more simple than prior art processes since it replaces the multiple grooves of the prior art with a single groove. In addition, by preselecting the included angle of the V-shaped groove, strong box-like structures having any number of sides and shapes may be formed. These structures may be used not only for packaging purposes but also for many furniture applications, such as, cabinets and tables. The structures may be covered with a decorative laminate to give them an attractive appearance.

According to one aspect of the invention, an apparatus is provided for forming a groove in a sheet of board material. The apparatus comprises a grooving tool which is provided with a V-shaped leading cutting edge having a preselected included angle to cut a V-shaped groove to a selected depth in the board material. The board material is guided and maintained firmly against a support by a hold down and the V-shaped groove is formed by driving the board material relative to the grooving tool to cut the V-shaped groove in the board material. Optionally, the grooving tool is mounted on the hold down and is adjustable to vary the depth of the V-shaped groove formed.

According to a feature of the invention, a method is provided for forming a groove in a sheet of board material. The groove is formed by guiding and advancing a sheet of board material relative to the V-shaped cutting edge of the grooving tool and cutting a V-shaped groove having a preselected included angle to a preselected depth in the board material. After the board material is grooved, box like structures may be formed by folding the board material along the grooves.

In order to insure a properly formed groove, the method may also include supporting the sheet on a support and maintaining the sheet in firm engagement with the grooving tool as the sheet advances relative to the grooving tool.

According to a further feature of the invention, a grooving tool is provided for forming a V-shaped groove in board material. The tool includes a body which is provided with a V-shaped cutting edge having a preselected angle. In one preferred embodiment, the tool includes a body having a shank portion and a shoe portion, the shank portion being adapted for fastening the grooving tool to a support and, the shoe portion preferably including a V-shaped bottom which is adapted for fitting in the V-shaped grooves. At the end of the shoe portion a V-shaped leading cutting edge having a preselected included angle is formed. Preferably, the inner contour of the shoe portion is curved to direct the V-shaped fillet cut from the groove away from the sheet.

The above and other advantages of the invention will become apparent from the following description of the preferred embodiments of the invention.

BRIEF DESCRIPTION OF THE DRAWINGS

FIG. 6 is a plan view of a sheet of board material used with the present invention.

FIG. 7 is a plan view of another board sheet utilized with the invention.

DETAILED DESCRIPTION OF THE PREFERRED EMBODIMENT

Figures 1, 5:
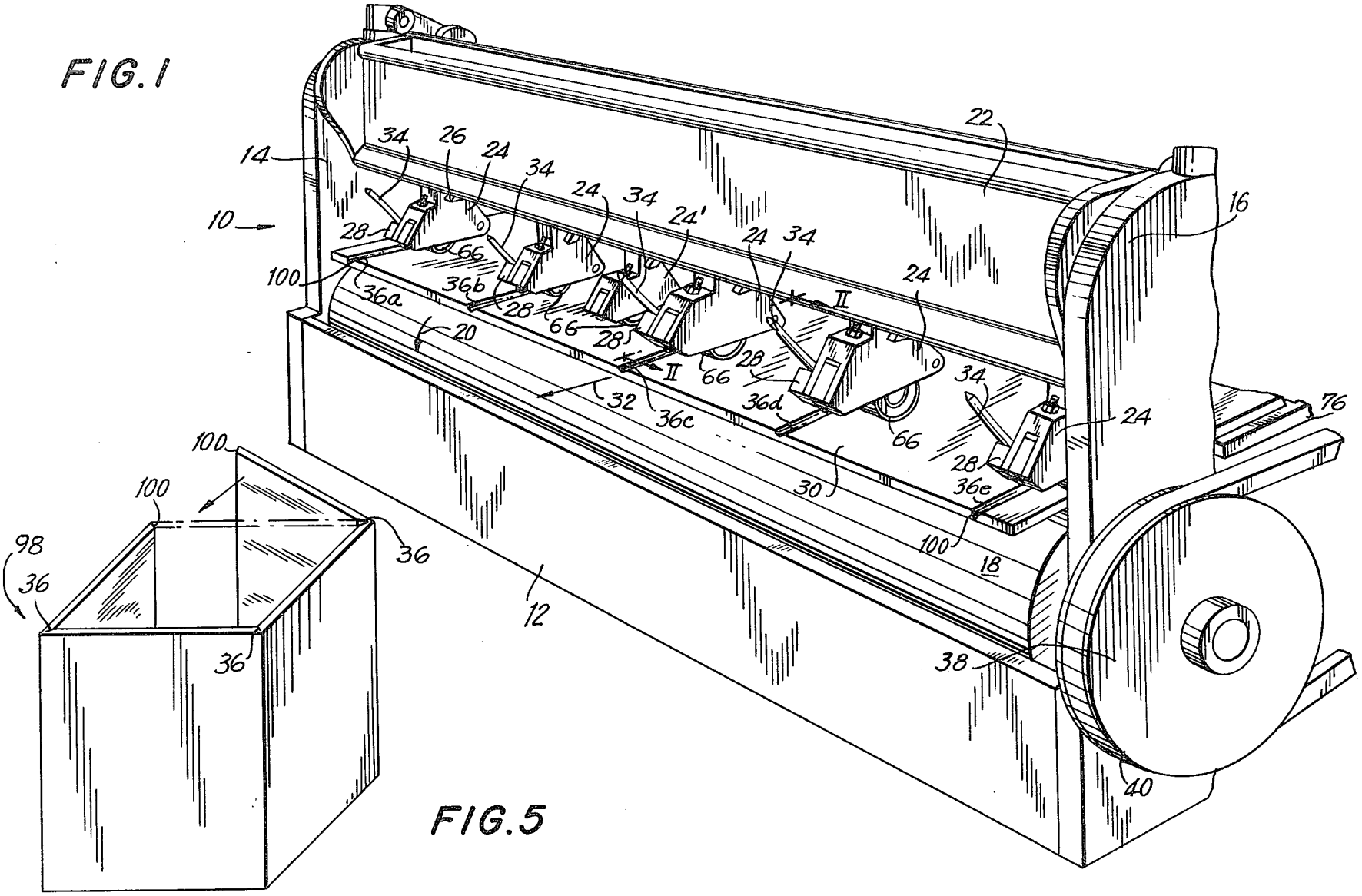
FIG. 1 is a perspective view of a grooving apparatus according to an embodiment of the present invention.
FIG. 5 is a perspective view of a box, partially assembled, made according to an embodiment of the invention.

FIG. 1 illustrates a grooving machine 10 according to an embodiment of the invention. Grooving machine 10 includes a base 12 and first and second side walls 14 and 16. A heavy roller 18, preferably of steel, is journalled in side walls 14 and 16 to rotate in the direction shown by an arrow 20. A superstructure 22 mounted between side walls 14 and 16 and above roller 18 supports a plurality of hold-downs 24 in a predetermined relationship to roller 18 and side walls 14 and 16. Hold-downs 24 may optionally be laterally displaceable using, for example, a dovetail 26 which, although shown in cross section in FIG. 2 for clarity, extends substantially the full width below superstructure 22. Thus, hold-downs 24 can be laterally positioned anywhere across the width of the grooving machine between side walls 14 and 16. Hold-downs 24 each include a hold-down wheel 66. A grooving tool 28 is affixed to certain hold-downs 24. A board 30 to be grooved is supported on a platform 76 which is positioned tangential to roller 18. Roller 18 which rotates in the direction of arrow 20 is belt driven through a pulley 38 coaxial with roller 18. A guard 40 prevents accidental contact with pulley 38 or the belt.

Board 30 is fed and pinched between wheels 66 and roller 18 and is thus forceably moved in the direction of an arrow 32. As board 30 is advanced relative to grooving tools 28, the grooving tools 28 cut V-shaped fillets 34 from the surface of board 30 forming V-shaped grooves 36*a* through 36*e*. Although hold-downs 24 are shown in association with grooving tools 28, additional hold-downs 24' may be employed to securely pinch board 30 between hold-down wheel 66 and roller 18. In a preferred embodiment, from 3 to 6 additional hold-downs 24' are disposed between those shown. If insufficient hold-downs are provided, board 30 tends to turn or snake while being grooved resulting in curved V-shaped grooves 36.

The rotating mass of roller 18 smoothly drives board 30 through the apparatus. Although it is normal to drive such a roller with a motor of 1 or 2 horsepower, improved operation is achieved with higher power. In a preferred embodiment, a roller weighing about 700 pounds is driven by a 7.5 horsepower motor.

Figure 2:
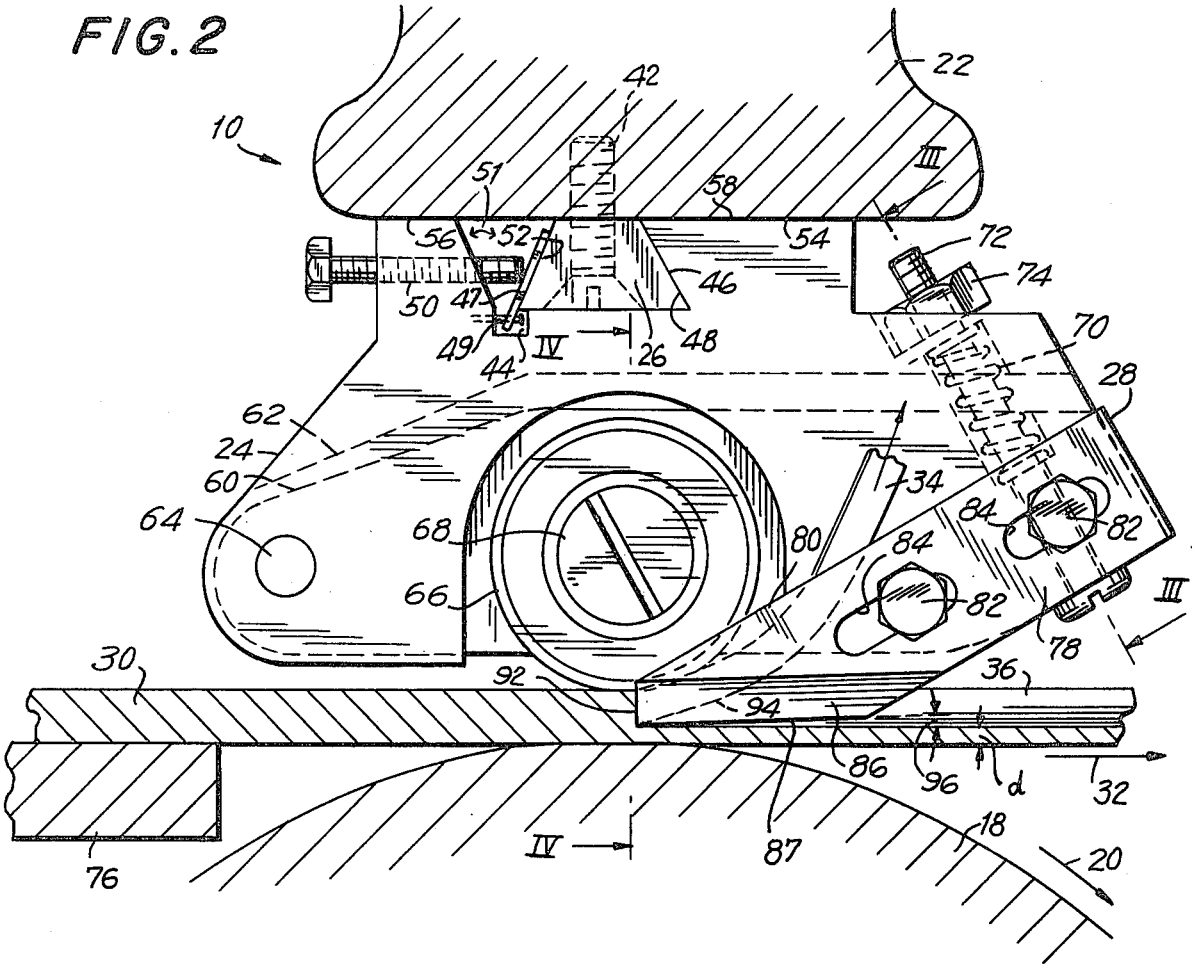
FIG. 2 is a side sectional view of the grooving apparatus of FIG. 1 taken along II—II of FIG. 1 showing an embodiment of a grooving tool and hold down according to the invention.
Figure 3:
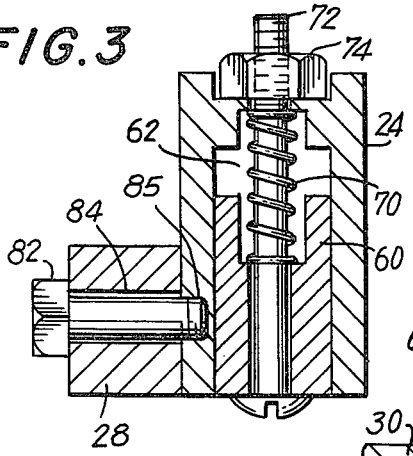
FIG. 3 is a back sectional view of the hold down and grooving tool taken along III—III of FIG. 2 illustrating a mechanism for urging the wheel of the hold down against the board being grooved.
Figure 4:
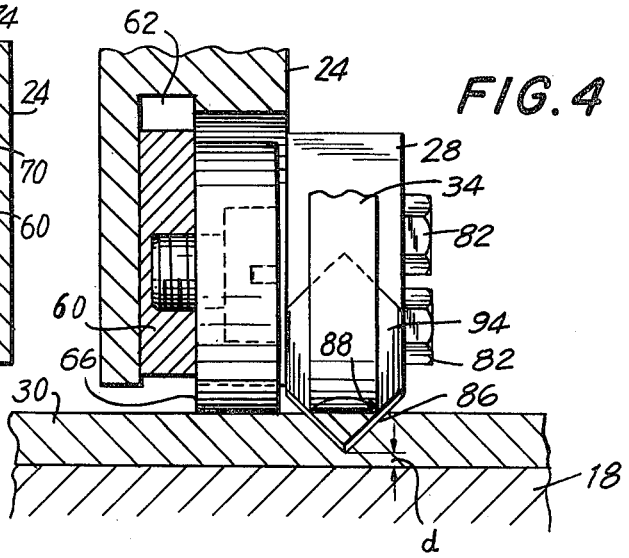
FIG. 4 is a front sectional view of the hold down and grooving tool taken along IV—IV of FIG. 2 showing the grooving tool cutting a groove in the board material.

FIGS. 2, 3 and 4 illustrate a hold-down 24 maintaining the board 30 in firm contact with the roller 18 and maintaining the board 30 in firm contact with grooving tool 28 as the board 30 is driven past grooving tool 28.

Referring to the top of FIG. 2, dovetail 26 is attached to superstructure 22 using a number of countersunk screws 42 (one of which is shown in dashed lines). A slot 44 in hold-down 24 includes a beveled abutment surface 46 which is operative to abut a matching beveled surface 48 on dovetail 26. A holding member such as, for example, a rectangular plate 47 is held by two pins 49 (one of which is shown) which pass through plate 47 and are held fast in hold-down 24. Plate 47 is movable in the direction of arrow 51 on pins 49. A screw 50 is suitably threaded through hold-down 24 and has its ends in stabilizing contact with plate 47 forcing the plate into abument with beveled tail surface 52 of dovetail 26. A forward flat upper surface 54 and a rear flat upper surface 56 of hold-down 24 are drawn upward into stabilizing contact with a flat lower surface 58 of superstructure 22 by forcing together the beveled abutment surface 46 and beveled surface 48 to securely hold and stabilize hold-down 24 against superstructure 22.

In the lower left hand portion of FIG. 2, a pivoted member 60 within a cavity 62 in hold-down 24 is pivoted at an axis 64. Hold-down wheel 66 is a bearing which is rotatable on an axle 68 suitably screwed into pivoted member 60. A compression coil spring 70, in the right hand portion of FIG. 2 and also shown in FIG. 3, is biased between the body of hold-down 24 and the trailing end of pivoted member 60 to urge pivoted member 60 in the clockwise direction of FIG. 2 about axis 64 and thus to urge hold down wheel 66 firmly against board 30. A limit screw 72 adjustable by a limit nut 74 passes through the helix of compression coil spring 70 to limit the outward travel of pivoted member 60 under the urging of compression coil spring 70.

Hold-down 24 may be constructed without a spring-biased pivoted member. Satisfactory operation has been obtained using a rigid hold-down 24. The effect of a rigid hold-down may be achieved by fully tightening limit screw 72 and nut 74 or by fabricating a solid hold-down 24 (not shown) in which the hold-down wheel 66 is rotatably affixed to the body thereof.

Referring also to FIG. 1, a platform or table 76 is provided at the run-in side of grooving machine 10 to support and feed board 30 to the nip between hold-down wheel 66 and roller 18. A suitable platform or table (not shown) may also be provided at the run-out side of the apparatus to receive board 30 after the grooving operation is completed.

As illustrated in FIGS. 2 and 4, grooving tool 28 has a shank portion 78 and a shoe portion 80. Shank portion 78 is substantially rectangular for close abutment to its support member which may be, for example, hold-down 24 (FIG. 4). A plurality of capscrews 82, passing through slotted openings 84, are threaded into threaded holes 85 (FIG. 3) in hold-down 24 to adjustably clamp grooving tool 28 against hold-down 24. As can be seen in FIG. 2, the range of adjustment of grooving tool 28 permits the depth of groove 36 to be adjusted to a preselected value which may be shallow or in the extreme, fully through board 30 whereby board 30 is severed. Thus, dimension d, measured from the bottom of groove 36 to the opposite surface of board 30, is controllable by loosening capscrews 82 and sliding grooving tool 28 upward and downward guided by slotted openings 84.

Shoe portion 80 has a V-shaped bottom 86 having a substantially straight lower edge 87 and having an included angle 88 (FIG. 4) substantially equal to the included angle of fillet 34 and groove 36. V-shaped bottom 86 has a V-shaped sharpened leading or cutting edge 92 disposed to cut or slice board 30 when it is moved in the transport direction 32 (FIG. 2). The opposing sides of V-shaped bottom 86 are substantially coplanar with opposing sides of V-shaped edge 92.

The grooving tool 28 is provided with an inner contour 94, shown dashed in FIG. 2 and solid in FIG. 4, which is curved to smoothly lift the V-shaped fillet 34 from the position at which it is severed by cutting edge 92 to the discharge position shown.

To resist dulling by the abrasive nature of, for example, particle board, at least cutting edge 92 may be made of hardened material such as hardened tool steel. In the preferred embodiment, the entire grooving tool 28 is hardened tool steel.

Bottom edge 87 of V-shaped bottom 86 may ride tightly in V-shaped groove 36 or it may be tilted upward a small angle, such as angle 96. Angle 96 is preferably as small as two or ten degrees, inclusive but satisfactory operation has been achieved with angle 96 as large as 20 degrees. By keeping angle 96 small, cutting edges 92 perform a shaving action on board 30 to produce a smooth clean V-shaped groove 36. Best operation is achieved with angle 96 about 7 degrees.

The permissible values of included angle 88 of cutting edge 92 depend upon the thickness d from the bottom of V-shaped groove 36 to the outside surface of board 30. If d is very small (approaching zero), angle 88 may approach 90 degrees to form a square corner. As thickness d increases somewhat, angle 88 must increase to provide clearance for fibers pressed into the inner radius of the bend. An angle as large as 95 degrees has given satisfactory results for producing square corners with best results being obtained in the range of 91.5 to 93.5 degrees, inclusive. However, if d is permitted to grow too large, the corners formed may be rounded.

In use, hold-downs 24 and attached grooving tools 28 having a preselected angle 88 are secured at desired positions along the length of dovetail 26. Additional hold-downs 24' may be provided to improve stability. In addition to maintaining the grooving tool 28 in firm engagement with board 30 while cutting the grooves 36, the hold-downs 24 guide the board 30 to prevent the board from turning as the grooves 36 are formed.

The number of grooving tools 28 utilized and the spacing between grooving tools 28 is dependent on the number of folds and the shape of the structure desired. In FIG. 1, five grooving tools 28 are illustrated and are positioned such that the distances between adjacent grooving tools are the same.

Before feeding board 30 between roller 18 and hold-downs 24, the hold-downs 24 and the grooving tool 28 are adjusted so that the grooves 36 are formed properly in the board 30. In order to adjust the tension of hold-down wheel 66 against the board 30, limit screw 72 is adjusted. By tightening limit screw 72, the coil spring 70 of hold-down 24 is compressed resulting in more tension between hold-down wheel 66 and roller 18. When limit screw 72 is loosened, spring 79 relaxes and tension between wheel 66 and roller 18 is decreased. Optimally, wheel 66 exerts just enough tension on board 30 to prevent the board from turning as it passes between the roller 18 and wheel 66. However, excess tension should be avoided to prevent excessive drag on board 30.

The depth to which grooving tool 28 cuts is adjusted by loosening capscrews 82 permitting grooving tool 28 to slide along the length of slotted openings 84 and move cutting edge 92 either closer to or away from roller 18. Capscrews 92 are tightened in threaded holes 85 to clamp grooving tool 28 against hold-down 24 when the desired adjustment is made. The cutting edge 92 may be brought close enough to roller 18 such that the cutting edge cuts entirely through board 30 and board 30 is severed. In FIG. 1, the two grooving tools 28 forming grooves **36*a* and 36*e* are adjusted to cut completely through board 30. The three interior grooving tools 28 forming grooves 36*b*, 36*c* and 36*d*** are adjusted to cut to a preselected depth which is less than the thickness of the board.

After the adjustments are made, the grooving machine 10 is operated by rotating roller 18 which is belt driven through pulley 38. As roller 18 rotates in the direction of arrow 20, board 30, which is supported on platform 76, is fed between hold-down wheel 66 and roller 18. The board 30 is driven in the direction of arrow 32 past grooving tools 28. Five grooves **36*a,b,c,d*** and *e* are formed. Grooves **36*b,c*** and *d* are V-shaped grooves and grooves **36*a* and 36*e*, which are cut entirely through board 30, form beveled ends 100**.

The board 30 with the grooves 36 formed therein is folded along grooves **36*b*, *c*** and *d* until the sides of each groove meet to produce three of the four corners of rectangular structure 98 (FIG. 5). The beveled ends 100 are brought together and secured to form the fourth corner of the rectangular structure.

FIG. 5 illustrates such a rectangular structure or box 98 partially assembled, of grooved board 30. Three V-shaped grooves 36, when folded until their sides substantially meet, produce three of the four corners of rectangular structure 98. The remaining beveled ends 100 of structure 98 are mated as shown by the dashed line to form the fourth corner of the structure. Referring also to FIG. 1, ends 100 are formed by cutting V-shaped grooves **36*a* and 36*e* completely through board 30 to leave the substantially 45 degree beveled ends 100. Thus, when the box structure is closed, the beveled ends 100 closely abut each other to complete the structure. For strength, glue may be coated on the beveled surfaces of grooves 36 and ends 100 before folding into the shape shown in FIG. 5 whereby the facing surfaces are bonded together. Other means of securing the beveled ends of box 98** together such as, for example, metal fasteners or flexible tapes, are included within the scope of the present invention.

FIG. 6 illustrates an S-shaped board 101 used in making a four-sided box having a top and bottom. By cutting vertical grooves **102*a,b,c*** and *d*, and horizontal grooves **104*a,b,c,d,e*, five panels A,B,C,D and E are formed. At points along the outer edge of S-shaped board 101, where grooves 102 and 104 are not formed between two adjacent panels, the grooves 102 and 104 bevel the circumference of S-shaped board 101 similar to beveled ends 100 formed on board 30**.

In use, the S-shaped board 101 is driven past four grooving tools 28 of grooving machine 10 to form grooves 102*a* to *d*. The board 101 is then rotated 90 degrees and driven past five grooving tools of grooving machine 10 to form grooves 104*a* to *e* and panels A to E. By folding panels B,C,D and E along grooves 104*b,c,* and *d* to bring outer edges 110*a* and 110*b* together, a four-sided structure is formed. Edges 110*a* and 110*b* may be secured in any convenient manner, such as with a metal fastener. Panels A and F form the top and bottom of the structure. Groove 102*c* between panels A and B forms a hinge 113*a* between panels A and B. Groove 102*b* between panels E and F forms a hinge 112*b* between panels E and F. When panels A and F are folded along hinges 113*a* and *b* to form the top and bottom of the structure, the beveled circumference of the S-shaped board 101 permits a tight fit between panels A and F and the structure formed by panels B,C,D and E. The three unattached sides of panels A and F may be attached to the structure formed by panels B,C,D and E in any convenient manner. In order to form a box which can be opened and closed, the three unattached sides of either panel A or panel F may be left unattached or one of the free sides may be secured to either panel B,C,D or E with a conventional latching device.

Referring to FIG. 7, another board construction used for making a structure is illustrated. A rectangular board 105 is formed having five grooves 106*a,b,c,d* and *e*. Grooves 106*a* and *c* at board edges 114*a* and *b* bevel the edges 114*a* and *b* in a manner like beveled edges 100 of board 30. Board edges 114*c* and *d* are not beveled. The board 105 is provided with two additional grooves 108*a* and *b* which are at 90 degrees to grooves 106. The portion of grooves 106*b,c* and *d* between groove 108*a* and board edge 114*c* and between groove 108*b* and edge 114*d*, passes through board 105 and forms six cuts 112 in the board 105. Thus, 12 panels, H through S are formed in board 105. Panels L, M, N and O may be folded along grooves 106*b,c* and *d* to bring edges 114*a* and 114*b* together to form a four-sided structure. Panels H, I, J and K and panels P, Q, R and S may be folded along grooves 108*a* and 108*b*, respectively to form the top and bottom of the structure.

In use, board 105 is driven past five grooving tools 28 of machine 10 to form grooves 106*a,b,c,d* and *e*. Cuts 112 may be formed, prior to or after grooves 106*a* to *e* are formed, by any conventional slicing method. Alternatively, cuts 112 may be formed by grooving tool 28 at the same time that grooves 106 are formed. However, this requires modifying grooving machine 10, by, for example, providing that superstructure 22 be slidable vertically relative to arrow 32 and suitably cammed to raise and lower grooving tools 28 at fixed intervals. As edge 114*c* of board 105 is fed between roller 18 and hold-down wheel 66, grooving tools 28 may initially be set to cut entirely through the board 105 for the length of cut 112. Superstructure 22 may slide up in response to a camming device to form grooves 106 and then slide down to form cuts 112 in edge 114*a* of board 105.

In order to make grooves 108*a* and *b*, the board 105 is rotated 90 degrees and driven past two grooving tools 28 of grooving machine 10.

Once grooves 106 and 108 and cuts 112 are made, board 105 is folded along grooves 106*b, c* and *d* edges 114*a* and 114*b* are abuted next to each other and attached to form a box structure with four sides, panels L, M, N and O. Panels H, I, J and K may be folded along groove 108*b* to form the box top and panels P, Q, and S may be folded along groove 108*b* to form the box bottom. The top and/or bottom may be secured with glue or other suitable means. As an example, the top side of panels P and R may be glued to the bottom side of panels Q and S.

Although FIGS. 5, 6 and 7 depict rectangular structures, it should be understood that structures having other shapes and having a different number of sides may be made by varying the number of grooving tools 28 and the size of included angle 88.

Generally, the number of grooving tools utilized will directly relate to the number of sides of structure formed. If the grooving tools are used to form grooves in the interior of a board and also to bevel the edges of a board, as illustrated in FIG. 1, the number of grooving tools will be $n+1$, where n is the number of sides of the structure to be formed. If the grooving tools 28 are utilized only to form grooves in the interior of the board, and the edges of the board are not beveled, $n-1$ grooving tools will be utilized.

The distance between grooving tools will determine the shape of the structure. For instance, in order to form a structure having n sides equal in length, the $n+1$ grooving tools should be provided with an equal distance between adjacent tools. To obtain a square structure, five adjacent grooving tools should be provided with an equal distance between them. A rectangular structure is formed by positioning five grooving tools such that the distance between the first and second grooving tools is equal to the distance between the third and fourth grooving tools. Also, the distance between the second and third grooving tools is equal to the distance between the fourth and fifth grooving tools.

By changing the size of the included angle 88, the angle of the corners formed may be varied. Generally, to form a corner having an angle of X degrees, the included angle 88 of the grooving tool 28 will be X degrees plus an adjustment factor, between 0 and 5 degrees, inclusive. The adjustment factor depends upon the thickness d from the bottom of the groove to the outside surface of the board. In general, if d is very small the included angle 88 may approach the angle desired for the corner being formed. As d becomes thicker, the adjustment in the included angle must be made to provide for clearance for the fibers pressed into the inner radius of the fold. Thus, the angle 88 must be increased. The adjustment does not generally exceed 5 degrees. For a structure having n sides each equal in length, the included angle 88 will be (360/n) degrees plus the adjustment factor.

Materials utilized with this invention are generally board materials, such as paper-based boards, paper board, corrugated paperboard or particle board. However, other types of board-like material, including foam board or plaster board are also suitable.

The invention is also especially useful for grooving board materials which are generally thicker than those used in the art of box making from paper-based materials. It is particularly useful for grooving board material of at least 150 points (0.150 inches) and especially for materials with thicknesses of from 200 points to 300 points, inclusive. By grooving materials of these thicknesses, structures may be formed which possess the strength and durability of structures made from more expensive materials, such as, plywood or flake board.

In one application of the invention, a rectangular piece of 250 point particle board (about 0.250 inches thick) was coated with a decorative vinyl film which simulated a wood grain. The board was grooved with five grooving tools in the manner described in FIG. 1. Each grooving tool had an included angle of 92 degrees. Adjacent grooving tools were spaced equidistant from each other and the first and fifth grooving tools were adjusted to cut completely through the board and vinyl film and bevel the edges of the board. The second, third and fourth grooving tools were adjusted to groove completely through the particle board down to the inner surface of the vinyl film. Thus, the board was hinged on the vinyl film such that folding the board along the grooves and abutting the two beveled edges produced four sharp clean corners. The facing surfaces of the grooves were glued and the abutting two beveled surfaces were attached. The precision grooving and folding produced a structure simulating a wooden cabinet having corners which were strong and accurately formed.

The terms and expressions employed herein are terms of description and not limitation. There is no intention to exclude any equivalence of the features shown and described. It is recognized that various modifications are possible within the scope of the invention claimed.

I claim:

1. Apparatus for grooving board material having a first and second surface comprising:

a grooving tool means having a V-shaped leading cutting edge with a preselected included angle for cutting a V-shaped groove in the first surface of the board material to a depth which is a preselected distance from the second surface, said grooving tool means including an elongated member, one end of which is provided with the V-shaped leading cutting edge;

means for producing relative movement of said grooving tool means and said board material to cut the V-shaped groove in said board material;

guide means for inhibiting nonlinear relative movement of said V-shaped leading cutting edge and said board material while cutting the V-shaped groove to cause a straight groove to be cut in said board, said guide means including hold down means for maintaining said board material in firm engagement with said V-shaped leading cutting edge while cutting said V-shaped groove, said hold down means including a body, a first member pivoted to said body, a second roller rotatably affixed to said first member and spring loading means for urging said second roller against said board material to resiliently press the board material against the movement producing means; and a superstructure supported over said grooving tool means, said hold down means being affixed to said superstructure and said grooving tool means being adjustably mounted on said hold down means to adjust the preselected distance of the V-shaped groove from the second surface of the board material.

2. Apparatus for grooving board material having a first and second surface comprising:

a grooving tool means having a V-shaped leading cutting edge with a preselected included angle for cutting a V-shaped groove in the first surface of said board material to a depth which is a preselected distance from the second surface;

means for producing relative movement of said grooving tool and said board material to cut the V-shaped groove in said board material;

guide means for inhibiting nonlinear relative movement of said V-shaped leading cutting edge and said board material while cutting the V-shaped groove to cause a straight groove to be cut in said board;

said grooving tool means including an elongated member having an upper shank portion and a lower shoe portion, said lower shoe portion extending between the upper shank portion and the V-shaped leading cutting edge and being provided with a V-shaped bottom surface adjacent to and extending away from the V-shaped leading cutting edge, said V-shaped cutting edge having first and second sides which form the V-shaped leading cutting edge, the V-shaped bottom surface having third and fourth sides substantially coplanar with the first and second sides of the V-shaped leading cutting edge; and p1 said guide means including hold down means for maintaining the board material in firm engagement with the V-shaped leading cutting edge while cutting the V-shaped groove, said upper shank portion being adjustably mounted in said hold down means for adjusting the preselected distance of the V-shaped groove from the second surface of the board material.

3. The apparatus according to claim 2, wherein the shoe portion of the grooving tool is provided with an inner curved contour means between said third and fourth sides for lifting a V-shaped fillet, cut from said board material to form the V-shaped groove, away from said V-shaped groove.

4. Apparatus for grooving board material having a first and second surface comprising:

a grooving tool means having a V-shaped leading cutting edge with a preselected included angle for cutting a V-shaped groove in the first surface of said board material to a depth which is a preselected constant distance from the second surface;

means for producing relative movement of said grooving tool and said board material to cut the V-shaped groove in said board material; and guide means for inhibiting nonlinear relative movement of said V-shaped leading cutting edge and said board material while cutting the V-shaped groove to cause a straight groove to be cut in said board.

5. The apparatus according to claim 4, wherein said grooving tool means includes an elongated member, one end which is provided with the V-shaped cutting edge having the preselected included angle, and wherein said guide means includes hold down means for maintaining said board material in firm engagement with said leading cutting edge while cutting said V-shaped groove, said elongated member being adjustably mounted on said hold-down means to adjust the preselected distance of the V-shaped groove from the second surface of said board material.

6. The apparatus according to claim 4, wherein said producing means comprises a first roller.

7. The apparatus, according to claim 6, further including a support platform positioned tangentially to said first roller.

8. The apparatus, according to claim 5 or 6 wherein said hold-down means includes a second roller means for resiliently pressing the board material against the producing means.

9. The apparatus, according to claim 4, wherein said grooving tool means is adjustably mounted on said guide means for adjusting the preselected distance of the V-shaped groove cut in the board material from the second surface of said board material.

10. The apparatus, according to claim 5, wherein said grooving tool means is provided with a V-shaped bottom surface adjacent the V-shaped leading cutting edge and extending away from said V-shaped leading cutting edge, the V-shaped bottom surface being provided with a substantially straight lower edge.

11. The apparatus, according to claim 10, wherein the angle formed between the substantially straight lower edge and said groove is at least 0 degrees and not greater than 20 degrees.

12. The apparatus, according to claim 11, wherein said angle is at least 2 degrees and not greater than 10 degrees.

13. The apparatus according to claim 1, wherein said grooving tool means includes a first grooving tool means for producing a first groove in said board material at a first preselected distance from the second surface and a second grooving tool means for producing a second groove in said board material at a second preselected distance from the second surface.

14. The apparatus according to claim 13, wherein said first preselected distance is less than the thickness of said board material.

15. The apparatus according to claim 1, wherein the preselected included angle of said V-shaped leading cutting edge is at least 90 degrees and not greater than 95 degrees.

16. The apparatus according to claim 12, wherein said included angle is at least 91.5 degrees and not greater than 93.5 degrees.

17. The apparatus according to claim 2, including a superstructure supported over said grooving tool means, said hold-down means being affixed to said superstructure.

18. The apparatus according to claim 14, wherein said grooving tool means is affixed to said hold-down means.

19. The apparatus according to claim 15, wherein said hold-down means includes a second roller means for resiliently pressing the board material against the producing means.

20. The apparatus according to claim 5, wherein said grooving tool means includes an elongated tool member, one end of which is provided with a V-shaped cutting edge having a preselected angle, and said elongated member is adjustably mounted on said hold-down means to adjust the preselected distance of the V-shaped groove from the second surface of said board material;

said producing means including a first roller for advancing said board material linearly relative to said grooving tool means to form a linear V-shaped groove in said board material;

said hold-down means including a second roller means for resiliently pressing the board material against the first roller; and further including supporting means including a platform, positioned tangentially to said first roller.

21. The apparatus according to claim 20, wherein the preselected angle of said V-shaped cutting edge is at least 90 degrees and not greater than 95 degrees.

22. The apparatus according to claim 21, wherein said grooving tool means includes means for cutting five linear spaced-apart parallel V-shaped grooves in said board material.

23. Method for grooving a sheet of board material having a first and second surface comprising:

advancing said sheet relative to a V-shaped leading cutting edge of a grooving tool, said cutting edge having a preselected included angle;

simultaneously, guiding said sheet to prevent nonlinear relative movement of said leading cutting edge and said sheet of board material; and cutting a V-shaped groove in the first surface of the sheet of board material at a preselected distance from the second surface of the sheet of board material at said sheet advances relative to said V-shaped leading cutting edge.

24. The method, according to claim 23, further including:

supporting said sheet on a support; and maintaining said sheet in firm engagement with said V-shaped leading edge of said grooving tool as said sheet advances relative to said V-shaped leading cutting edge.

25. The method, according to claim 24, wherein said cutting step includes:

cutting a plurality of adjacent, substantially straight, spaced and parallel V-shaped interior grooves in a piece of board material, each of the V-shaped grooves having two opposing faces, a depth less than the thickness of the board material, a preselected first included angle, and being parallel to a first and second side of said piece of board material.

26. The method, according to claim 25, further including the step of beveling the first and second sides of said rectangular piece by cutting an additional V-shaped groove at a depth substantially equal to the thickness of said piece of board material, along each of said first and second sides.

27. The method, according to claim 25 or 26, further including the step of:

folding said piece of board along each of said plurality of interior grooves such that said first and second sides of the piece of board are brought into abutment and opposing faces of each of said interior grooves are brought into abutment to form a structure having a plurality of corners, each of said corners having a second included angle.

28. The method, according to claim 27, further including the step of:

fastening the first and second sides to form a structure having a number of sides equal to the number of interior grooves plus one.

29. The method, according to claim 28, wherein the size of said first included angle is equal to the size of the second included angle plus an adjustment factor not greater than 5 degrees.

30. The method, according to claim 29, wherein the number of sides of said structure is four.

31. The method, according to claim 30, wherein the second preselected angle is substantially equal to 90 degrees.

32. The method, according to claim 31, wherein the first included angle is between 90 and 95 degrees, inclusive.

33. The method, according to claim 32, wherein the first included angle is between 91.5 and 93.5 degrees, inclusive.

34. The method, according to claim 25 or 26, wherein the thickness of the board material is at least 150 points.

35. The method, according to claim 34, wherein the thickness is between 200 points and 300 points, inclusive.

36. A rectangular structure formed by the method of claim 27.

37. A rectangular structure formed by the method of claim 28.

38. The method according to claim 34, wherein the board material is particle board or chipboard.

* * * * *